United States Patent [19]

Graham

[11] Patent Number: 4,934,384

[45] Date of Patent: Jun. 19, 1990

[54] TOBACCO PIPE COMBUSTION ACCESSORY

[76] Inventor: Fred Graham, P.O. Box 423, Anna Maria, Fla. 34216

[21] Appl. No.: 419,898

[22] Filed: Oct. 11, 1989

[51] Int. Cl.[5] ..... A24F 1/00

[52] U.S. Cl. ..... 131/176; 131/194; 131/195; 131/329; 131/234

[58] Field of Search ..... 131/234, 176, 194, 195, 131/329

[56] References Cited

U.S. PATENT DOCUMENTS 1,349,276 8/1920 Hays ..... 131/176

*Primary Examiner*—V. Millin

*Attorney, Agent, or Firm*—Charles J. Prescott

[57] ABSTRACT

A tobacco pipe combustion maintenance accessory for maintaining continuous burning of tobacco in the bowl of a pipe once the tobacco is initially ignited. The device includes a generally flat body having a curvilinear concave reflective surface on one side of the body. When the body is held above the pipe bowl, the curvilinear surface, properly positioned, reflects heat and light waves emitting from the portion of burning tobacco back at the tobacco in focused or concentrated form to ignite the unlit portions of the tobacco at the point where the reflective rays focus. By manipulation of the device in very close proximity above the rim of the pipe bowl so that the rays are reflected downardly into the tobacco, the collected rays at their point of focus maintain the tobacco burning. The curvilinear surface is preferably a spherical segment and may also be structured similar to a fresnal lens having reflective concentric surfaces to achieve relative flatness and a shorter focal length. A preferred gold-colored reflective surface improves performance by more efficiently reflecting infrared rays. Various structures for holding the device are also provided.

8 Claims, 2 Drawing Sheets

TOBACCO PIPE COMBUSTION ACCESSORY

BACKGROUND OF THE INVENTION

This invention relates generally to tobacco pipes and more particularly to a device useful in maintaining continuous combustion of tobacco within the pipe.

Individuals who smoke tobacco using a tobacco pipe are well known to be required to exercise considerable diligence (fidgeting) in maintaining the tobacco in ignited condition until completely burned. Typically, the tobacco must be reignited several times to obtain the full combustion and satisfaction from each load of tobacco placed into the bowl of the pipe.

In addition to simply reigniting the tobacco, many users also use various well known devices including a book of matches and one's fingers to assist in obtaining a more conducive mixture of air flow and elevated temperature to maintain combustion.

In fact, it has been acknowledged by a retail sales tobacconist that the single most important acknowledged reason that pipe smokers discontinue their use is because of the difficulty in maintaining combustion during the entire burning life of the tobacco within the bowl.

One patented device known to applicant is disclosed in U.S. Pat. No. 3,709,233 to Stelitano which teaches a tobacco pipe construction which provides a small opening through which the tobacco is ignited, after which a sliding cover may be utilized, in part, to facilitate continuous tobacco combustion.

Two other patented devices are also known to applicant. U.S. Pat. No. 3,117,579 to Alsafrana discloses a uniquely structured pipe having a pivotal side portion through which the tobacco is placed into the bowl. The tobacco pipe invented by Hefti as disclosed in U.S. Pat. No. 3,106,922 includes a pivotal end plate for containing the tobacco within the bowl and having a mesh portion which helps to regulate air flow.

The present invention provides an easily positionable accessory which may be manipulated by hand directly above the tobacco burning within a conventional pipe bowl after the tobacco is initially ignited. The device, when properly positioned and manipulated, reflects and focuses light and heat waves emitting from the partially burning tobacco back into the bowl in focused fashion so as to ignite (or reignite) unlit portions of the tobacco.

BRIEF SUMMARY OF THE INVENTION

This invention is directed to a tobacco pipe combustion maintenance accessory for maintaining continuous burning of tobacco in the bowl of a pipe once the tobacco is initially ignited. The device includes a generally flat body having a curvilinear concave reflective surface on one side of the body. When the body is held above the pipe bowl, the curvilinear surface, properly positioned, reflects heat and light waves emitting from the portion of burning tobacco back at the tobacco in focused or concentrated form to ignite the unlit portions of the tobacco at the point where the reflective rays focus. By manipulation of the device in very close proximity above the rim of the pipe bowl so that the rays are reflected downwardly into the tobacco, the collected rays at their point of focus maintain the tobacco burning. The curvilinear surface is preferably a spherical segment and may also be structured similar to a fresnal lens having reflective concentric surfaces to achieve relative flatness and a shorter focal length. A preferred gold-colored reflective surface improves performance by more efficiently reflecting infrared rays. Various structures for holding the device are also provided.

It is therefore an object of this invention to provide an accessory for tobacco pipe users to assist in maintaining continuous combustion of tobacco until completely burned.

It is another object of this invention to provide an easily manipulable accessory for maintaining pipe tobacco combustion.

It is yet another object to provide the above invention in a wide range of decorative forms to satisfy the broadest aesthetic range of pipe tobacco smokers.

In accordance with these and other objects which will become apparent hereinafter, the instant invention will now be described with reference to the accompanying drawings.

DETAILED DESCRIPTION OF THE INVENTION

Figure 1:
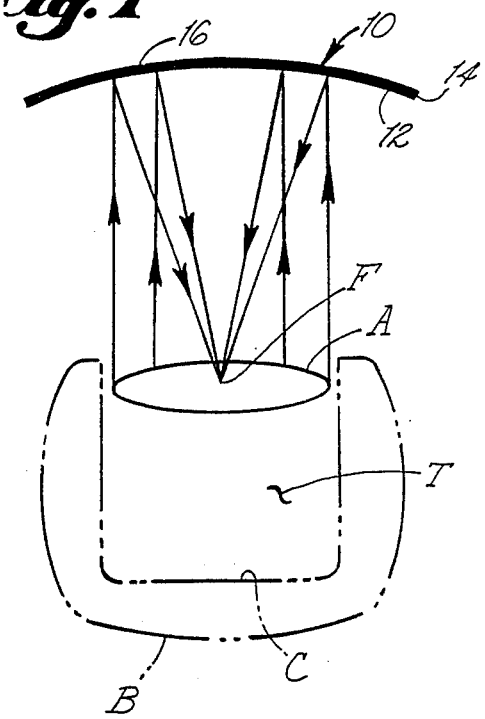
FIG. 1 is a side elevation schematic view of the invention in operation above the bowl of a conventional tobacco pipe shown in phantom.

Referring now to the drawings, and particularly to FIG. 1, a side elevation schematic view of the invention shown generally at numeral 10 is there shown. The invention 10 shown in schematic as a section view, includes a main body portion 14 having a concaved surface 12 and a back surface 16. The concaved lower surface 12 is reflective of light and heat waves and preferably is formed of a spherical section having a relatively short optical focal point at F. A pipe bowl B is shown in phantom which includes a central cavity C into which tobacco T is placed for smokable combustion.

During combustion of the tobacco T, a zone designated generally as A typically represents the area of combustion of the upper portion of the tobacco T. Combustion of even a small portion of the tobacco T in zone A results in emission of light and infrared rays upward in the direction of the arrows (and in all other directions outwardly from the bowl cavity C).

These light and infrared rays upwardly emitting from the combustion zone A strike and then downwardly reflect from the reflective surface 12 in the direction of the arrows to a focal point F. It is this focusing of these light and infrared rays at F which facilitates the recombustion or new combustion of unlit tobacco T in the zone A.

Thus by holding the device 10 at a proper distance above the pipe bowl B such that focal point F falls generally within zone A, the reflected and focused rays at F are sufficient to effect combustion of the tobacco T. By continued minor repositioning of the device 10 so that the focal point F is moved various places within zone A unlit tobacco in the entire zone A may be ignited. Once familiar with moving the device 10 to adjust the position of the focal point F both laterally (or angularly) and vertically, it is routinely possible to insure continuous combustion of all of the tobacco T once the initial ignition is effected.

The preferred embodiment has dimensions of the reflective surface 12 equal to a radius of curvature of 50 mm having a focal length of 25 mm and an overall diameter of approximately 35 mm.

It is here noted that, although the invention does not reflect all of the rays emitting from the burning tobacco, nonetheless a sufficient quantity of generally vertically emitting rays are reflected back by surface 12 to the focal point F so as to create a hot spot on the tobacco T sufficient to effect continued combustion and reignition as desired.

Figure 2:
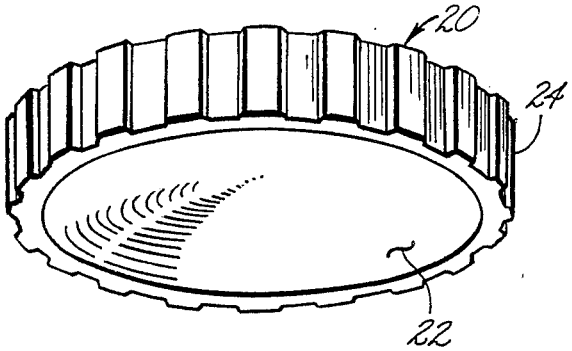
FIG. 2 is a lower perspective view of one embodiment of the invention.

Referring now to FIG. 2, another embodiment of the invention is shown generally at numeral 20 formed of a rigid, disc-shaped member having serrations or knurling 24 along its perimeter. Reflective surface 22 is again a segment of a sphere.

Figure 3:
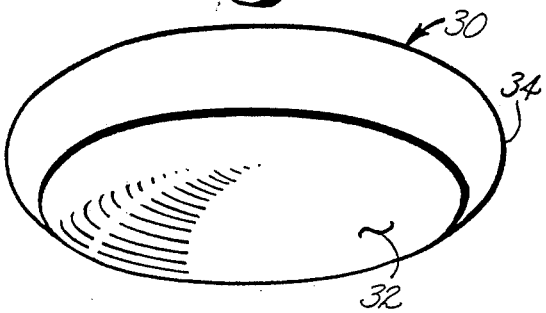
FIG. 3 is a lower perspective view of another embodiment of the invention.

Referring now to FIG. 3, yet another embodiment of the invention is shown generally at numeral 30, having a mirrored, reflective surface 32 formed as spherical segment. In this embodiment 30 the perimeter 34 is formed having a transverse semi-circular section providing another contour of sufficient thickness to facilitate hand holding of the device 30 during use.

Figure 4:
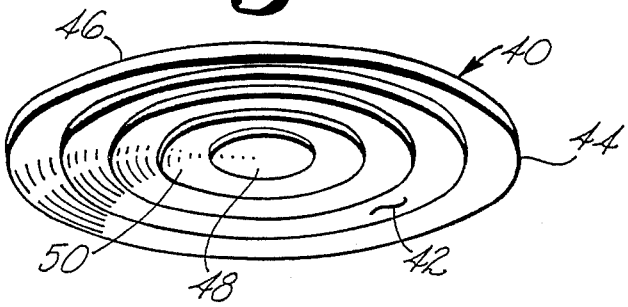
FIG. 4 is a lower perspective view of yet another embodiment of the invention.
Figure 5:
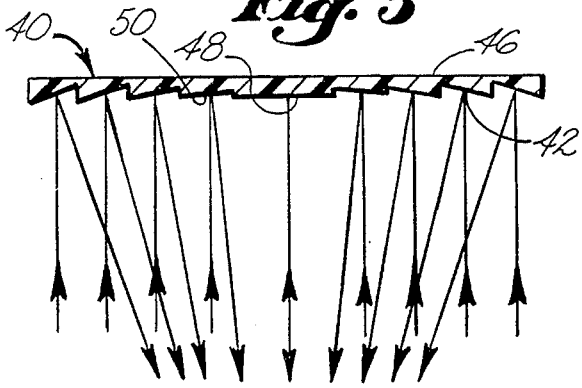
FIG. 5 is a section view of FIG. 4.

The embodiment of the invention in FIG. 4 shown generally at numeral 40 is provided for its thinness and may be adhered or molded onto a flat surface such as a book of matches or other more ornamental objects such as objects of jewelry and the like to enhance marketability. This embodiment 40 is generally circular having a transverse section as best seen in FIG. 5 similar to that of a fresnal lens. This embodiment 40 includes a mirrored, fresnal-type reflective surface shown generally at 42 having a series of concentric reflective surfaces beginning at the center portion 48 and outwardly extending in concentric reflective rings shown typically at 50 such that the rays upwardly emitting from the burning tobacco as shown in the direction of the upward arrows reflect from surface 42 back downwardly to a focal point (below FIG. 5) to effect ignition of the tobacco as previously described.

Figure 6:
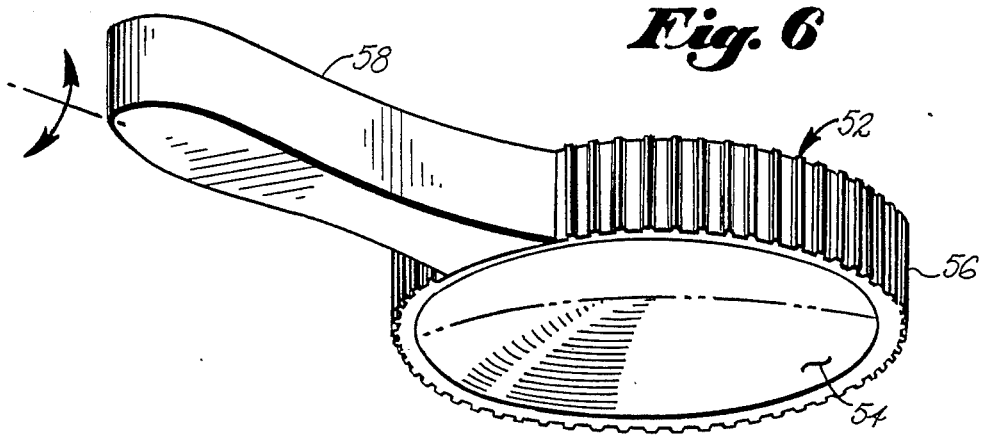
FIG. 6 is a lower perspective view of yet another embodiment of the invention.

Referring now to FIG. 6, yet another embodiment of the invention is shown generally at 52 having a spherical-segment mirrored or reflective surface 54 and having spaced transverse ribs 56 around the perimeter of the rigid circular body for holdability. This embodiment 52 also includes a lateral or radially extending handle 58 which is provided so that the user's fingers are somewhat removed from the close proximity to the burning tobacco. However, handle 58 provides quick, easy minor rotational reorientation of this embodiment 52 in the direction of the arrow to more easily achieve tobacco ignition over the entire zone A of FIG. 1.

Figure 7:
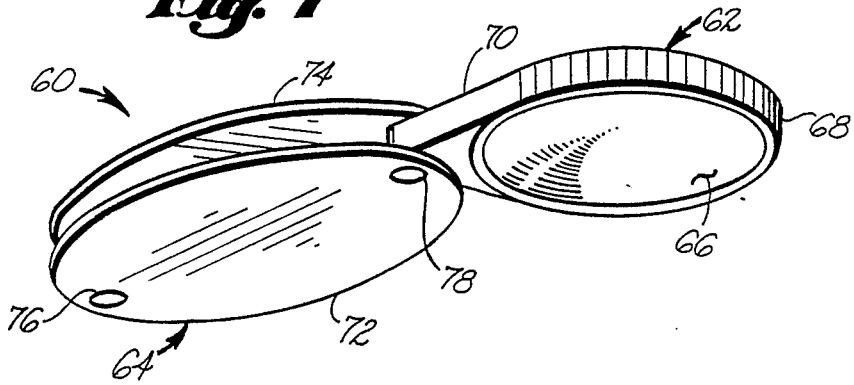
FIG. 7 is a perspective view of yet another embodiment of the invention.
Figure 8:
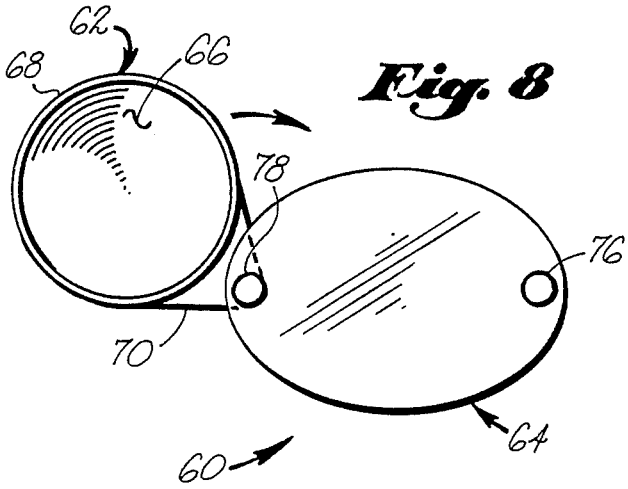
FIG. 8 is a bottom plan view of the invention as shown in FIG. 7 in its open position.
Figure 9:
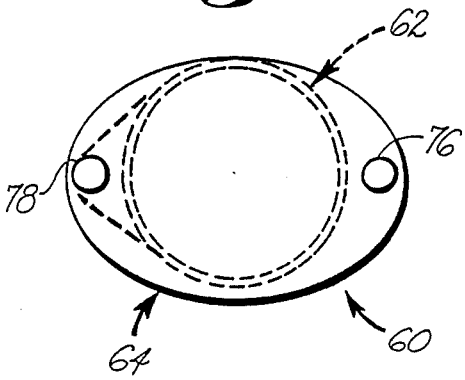
FIG. 9 is a bottom plan view of the invention as shown in FIG. 7 in its closed position.

Referring lastly to FIGS. 7, 8 and 9, another embodiment of the invention is there shown generally at numeral 60 having a rigid disc-shaped member 62 which includes a spherical-segment reflective surface 66 as previously described. Knurling along its perimeter at 68 is also provided for ease of opening and closing. The reflective body 62 includes extension 70 which is pivotally connected by pin 78 to holder 64. Holder 64 is formed of two spaced, thin flat panels 72 and 74 which are held in fixed parallel relation by pins 76 and 78.

Thus, as best seen in FIG. 8 and 9, the mirrored body 62 may be pivoted in the direction of the arrow in FIG. 8 from its open position for use about pin 78 to the protected, closed position as shown in FIG. 9. In a closed position, the mirrored surface 66 is thus protected by panels 72 and 74 from being scratched or dirtied.

Although the reflective surface may be achieved by a number of well known techniques, including mirrored glass, highly polished silver-colored or gold-colored precious metals or the like, the reflective surface of the preferred embodiment of the invention is formed by vacuum depositing a gold coating on the reflective surface. This gold coating increases the reflectivity of the reflective surface to between 95% and 98% with regard to infrared rays up to wave lengths about 15 microns. Energy waves in this spectrum carry the most energy of rays emanating from the burning pipe tobacco.

Any convenient focal length may be selected so long as the reflected rays are sufficiently strong when focused atop the tobacco to effect combustion. However, a very short focal length, whereby the device is held in very close proximity above and generally parallel to the rim of the pipe bowl is preferred.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A tobacco pipe combustion maintenance device for maintaining continuous burning of once-ignited tobacco in the bowl of a tobacco pipe, said device comprising:

a body having a curvilinear concaved reflective surface on one side of said body;

said body suitably sized and having hand gripping means for adjustably positioning said body above the pipe bowl with said reflective surface facing downwardly into the bowl;

said reflective surface structured to reflect and focus light and heat waves emanating from burning portions of the tobacco within the bowl back to ignite unlit portions of the tobacco when the device is positioned directly above the bowl;

said reflective surface having a focal length sized to ignite the unlit portions of the tobacco when said body is positioned in very close proximity directly above the rim of the bowl.

2. A tobacco pipe combustion device as set forth in claim 1, wherein:

said reflective surface is a spherical segment;

said body is disc shaped having a generally flat upper surface.

3. A tobacco pipe combustion device as set forth in claim 2, further comprising:

a gold-colored layer deposited on said reflective surface whereby infrared rays emanating from the burning portion of the tobacco are more fully reflected downwardly for use.

4. A tobacco pipe combustion device as set forth in claim 1, further comprising:

knurling formed into the perimeter of said body for enhanced holdability of said device during use.

5. A tobacco pipe combustion device as set forth in claim 1, further comprising:

a holder having spaced, parallel panels;

said body generally flattened and pivotally connected between said panels adjacent a common margin of said panels and said body whereby said body may be pivoted from a first position to a second position with respect to said panel;

said body fully between and protectably concealed by said panels when said body is in its first position;

said body extending from said panels and said panels serving as a handle for said body when said body is in its second position during use.

6. A tobacco pipe combustion maintenance device for maintaining continuous burning of once-ignited tobacco in the bowl of a tobacco pipe, said device comprising:

a body having a curvilinear concaved reflective surface on one side of said body;

said body suitably sized and having hand gripping means for adjustably positioning said body above the pipe bowl with said reflective surface facing downwardly into the bowl;

said reflective surface structured to reflect and focus light and heat waves emanating from burning portions of the tobacco within the bowl back to ignite unlit portions of the tobacco when the device is positioned directly above the bowl; and an elongated, slender handle extending radially outwardly from a perimeter point of said body, said handle generally coplaner with said reflective surface.

7. A tobacco pipe combustion device as set forth in claim 8, further comprising:

a gold-colored layer deposited on said reflective surface whereby infrared rays emanating from the burning portion of the tobacco are more fully reflected downwardly for use.

8. A tobacco pipe combustion maintenance device for maintaining continuous burning of once-ignited tobacco in the bowl of a tobacco pipe, said device comprising:

a body having a curvilinear concaved reflective surface on one side of said body;

said body suitably sized and having hand gripping means for adjustably positioning said body above the pipe bowl with said reflective surface facing downwardly into the bowl;

said reflective surface structured to reflect and focus light and heat waves emanating from burning portions of the tobacco within the bowl back to ignite unlit portions of the tobacco when the device is positioned directly above the bowl;

said body having a flattened shape similar to a generally fresnal lens and having a plurality of concentric reflective rings collectively forming said reflector surface.

* * * * *